US007065949B2

(12) United States Patent
Guevel et al.

(10) Patent No.: US 7,065,949 B2
(45) Date of Patent: Jun. 27, 2006

(54) CUT-RESISTANT YARN INTENDED ESPECIALLY FOR THE PRODUCTION OF PROTECTIVE GARMENTS

(75) Inventors: Jean Guevel, Lyons (FR); Guy Bontemps, Tenay (FR)

(73) Assignee: SA Schappe, Ban de Laveline (FR)

( * ) Notice: Subject to any disclaimer, the term of this patent is extended or adjusted under 35 U.S.C. 154(b) by 0 days.

(21) Appl. No.: 10/483,057

(22) PCT Filed: Aug. 21, 2002

(86) PCT No.: PCT/FR02/02918

§ 371 (c)(1),
(2), (4) Date: Feb. 12, 2004

(87) PCT Pub. No.: WO03/018890

PCT Pub. Date: Mar. 6, 2003

(65) Prior Publication Data

US 2004/0148921 A1 Aug. 5, 2004

(30) Foreign Application Priority Data

Aug. 24, 2001 (FR) ..... 01 11107

(51) Int. Cl.
*D02G 3/02* (2006.01)

(52) U.S. Cl. ..... 57/229; 57/232

(58) Field of Classification Search ..... 57/210, 57/229, 232; 65/432, 447, 450
See application file for complete search history.

(56) References Cited

U.S. PATENT DOCUMENTS

| | | | | |
|---|---|---|---|---|
| 5,177,948 | A | 1/1993 | Kolmes et al. | |
| 5,845,476 | A | 12/1998 | Kolmes | |
| 6,016,648 | A | 1/2000 | Bettcher et al. | |
| 6,880,321 | B1 * | 4/2005 | Guevel et al. | 57/229 |

FOREIGN PATENT DOCUMENTS

| | | |
|---|---|---|
| WO | WO 97/33841 | 9/1997 |

* cited by examiner

*Primary Examiner*—Shaun R Hurley
(74) *Attorney, Agent, or Firm*—Oliff & Berridge, PLC

(57) ABSTRACT

The invention concerns a yarn comprising a core (A) obtained by coextrusion of a glass multifilament E, R, C or S or more generally of glass silk or basalt and a polymer sheath of the thermoplastic, thermoset, natural elastomer fluorinated or non fluorinated synthetic elastomer type. The fiberglass part represents not more than 60 wt. % of the sheath+filament complex, and the core (A) is wrapped with synthetic multifilaments (B, C).

10 Claims, 1 Drawing Sheet

CUT-RESISTANT YARN INTENDED ESPECIALLY FOR THE PRODUCTION OF PROTECTIVE GARMENTS

Figure 1:
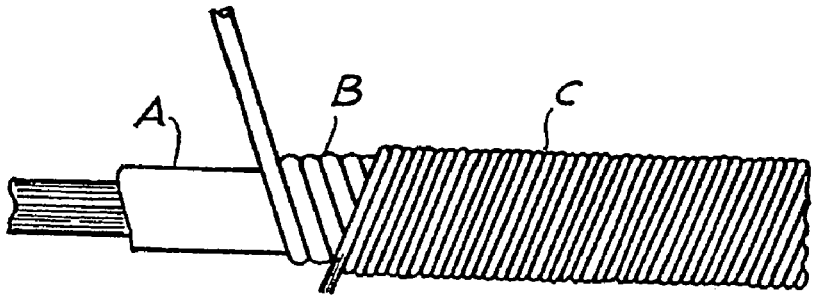

The subject of the present invention is a cut-resistant yarn intended especially for the production of garments for protection against mechanical attack.

It is widely known in the literature, and from the patents U.S. Pat. No. 3,883,898, GB 1 586 890, U.S. Pat. No. 4,777,789, U.S. Pat. No. 4,004,295, GB 2 018 323, DE 1 610 495 and, EP 0 118 898, that the combination of various fibrous materials of polymeric origin, or inorganic origin in the family of vitreous or ceramic, or metallic, compounds, are employed for the purposes of reinforcing yarns intended for the field of protection against mechanical attack and/or perforation.

Such personal protection equipment is most often in the form of gloves, sleeves, aprons or any part of a garment, and are generally knitted or, more rarely woven.

These parts of protective equipment must possess very good mechanical properties, in particular as regards shear stresses, without losing the flexibility and the lightness that are necessary for good dexterity.

In general, particular polymers are found to be the materials employed, such as polyamides, para-aramids, highmolecular-weight polyethylenes, LCP (Liquid-Crystal Polymer) fibres, polybenzimidazole and ceramic-filled polyester. These materials have in common the particular feature of being highly crystalline and consequently possessing a fairly high intrinsic hardness. This is because the hardness of the materials used is very high and substantially governs the cutting or shearing mechanisms to which they are exposed. As an indication, crystalline and semicrystalline polymeric materials have hardnesses, measured on the Mohs scale, of between 2 and 3 units.

The yarns made of pure polymers chosen from the above materials do not make it possible to achieve Class 5 classifications according to the European Standard EN388 for thin knits, ensuring good dexterity as must be the case with protective gloves intended for cutting. Such personal protection equipment, greatly used in the field of sheet metalwork, must, in addition to providing users with good grip, be very comfortable, ensuring that the equipment will always be worn by exposed personnel.

To solve the compromise, allowing gloves to be produced that are both flexible and light, and therefore comfortable, while still being classified as Class 5 according to EN388, many companies incorporate inorganic filaments in combination with polymeric filaments. Glass and stainless steel are generally used for reinforcement, without making the yarns intended for producing the cut-resistant protective gloves too heavy. The Mohs hardness of steel is 5 units and that of glass is 6/7 units.

The products proposed have two major drawbacks:

The glass or stainless steel filaments have a low bending resistance and break. The free ends, despite assemblies of polymer filaments intended to sheath them using wrapping operations, end up passing through the layers of the wrapped polymer filaments, the effect of which is to prick the hands of operators, who generally no longer wear the protective equipment.

To solve this problem, a glass treatment process, existing in the sunshade industry, has been profitably used. In this field, the glass filaments are used for their non-inflammable properties (M0 classification) These sunshades are placed inside buildings in front of windows and must fulfil, in addition to solar filtration, an aesthetic function. For these purposes, the glass filament, generally called textile glass filament, is coextruded with a polymeric resin fire-retarded in the bulk and tinted to the desired colour. These yarns are then woven and thermally fused at the intersection of the yarns to lock the network of yarns.

The object of the invention is to provide a cut-resistant yarn allowing the production of protective equipment which provides users with good safety and possesses good flexibility, conducive to comfort.

For this purpose, the yarn to which the invention relates, comprising a core obtained by coextrusion of a multifilament of E-, R-, C- or S-glass or more generally of textile glass or basalt filament and of a sheath of polymer of the thermoplastic, thermosetting, natural elastomer or synthetic elastomer type, fluorinated or otherwise, is characterized in that the glass fibre part represents at most 60% by weight of the filament+sheath compound, and in that the core is wrapped with synthetic multifilaments.

Advantageously, the core is doubly or triply wrapped with synthetic multifilaments.

The coextrusion part makes the core yarn more flexible than if it were made entirely of glass. Furthermore, the wrapping yarns are absolutely locked by the contact of the polymer constituting them on the coextruded polymer.

Thus, knitted products are obtained which achieve very high levels of abrasion resistance. Another substantial advantage is the protection of the glass filament against attack by chemicals, in particular hydrofluoric acid, in certain chemical or related industry sectors.

The extruded polymer sheath creates a perfect seal for the axial component consisting of the glass filament. The polymers used may be polyvinyl chlorides or polyurethanes, or any other chemically inert polymer.

As regards cut performance, level 5 is achieved very easily and is maintained even after 10 washings.

According to one feature of this yarn, the wrapping multifilaments are chosen from the following families: polyethylene having a high molecular weight, greater than 600, 000 g/mol, para-aramid having a modulus >50 GPa, high-tenacity and standard-tenacity polyamide, high-tenacity and standard-tenacity polyester, liquid-crystal polymer (LCP), polyphenylenebenzobisoxazole (PBO) and ceramic-filled polyester.

According to one embodiment, the various wrapping multifilaments consist of identical materials.

According to another embodiment, the various wrapping multifilaments consist, at least in the case of some of them, of different materials.

Three illustrative embodiments of a yarn according to the invention are described below with reference to the three figures of the appended schematic drawing, respectively.

1st Hybrid Yarn (FIG. 1)

This yarn is composed of a "core" A consisting of a glass yarn coextruded with a PVC-type resin of 100 tex overall linear density. The glass fibre part represents 35 tex and the PVC part 65 tex.

This composed "core" is covered by wrapping with a 220 dtex multifilament B made of polyethylene having a high molecular weight (greater than 600 000 g/mol), the degree of crystallinity of which is greater than 80% by volume. The covering is with touching turns, with a helix pitch of 1.5 mm i.e. a twist of 660 turns/metre in the S or Z direction; the linear density of the filament is 220 dtex with zero twist turns.

A second coveting is effected with a multifilament C of the same nature, with a helix pitch of 2 mm, i.e. a twist of 500 turns/metre in the reverse direction of the first filament layer.

The complete yarn therefore has an overall linear density of 100 tex+2×22 tex=144 tex.

The results from the yarn in the cutting test according to EN388 achieves the Class 5 rating, with a cutting index >45 after knitting on a fully-fashioned linear knitting machine of gauge 10.

The gloves obtained are light, very flexible and exhibit no glass filament fracture defect after 10 washings in an industrial machine.

Figure 2:
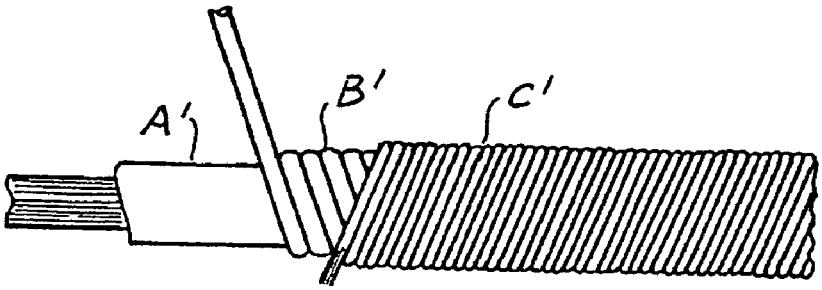

2nd Hybrid Yarn (FIG. 2)

This yarn is composed of a "core" A' consisting of a glass yarn coextruded with a PVC resin of 100 tex overall linear density. The glass fibre part represents 35 tex and the PVC part 65 tex.

This composed "core" is covered by wrapping with a 440 dtex para-aramid multifilament B' and the Young's modulus is between 60 and 120 GPa. The covering is with touching turns with a helix pitch of 3 mm for a twist of 333 turns/metre in the S or Z direction.

A second covering is produced with a 440 dtex high-tenacity nylon-6,6 multifilament C' possessing a degree of crystallinity >45% by volume. The complete yarn has an overall linear density of 110 tex+2×44 tex=188 tex.

This yarn, after knitting in gauge 7 on a linear knitting machine, entirely made up by the machine for producing protective gloves, was tested in cutting according to EN 388.

The gloves achieved Class 5 with a cutting index >60. After ten washing tests, the gloves exhibited no glass filament fracture.

Figure 3:
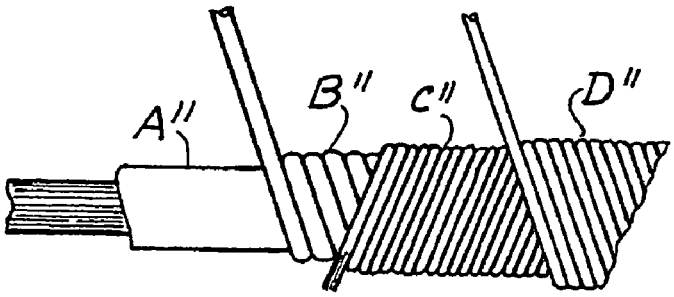

3rd Hybrid Yarn (FIG. 3)

This yarn is composed of a "core" A" consisting of a glass yarn coextruded with a PU resin, of 238 tex overall linear density. The glass fibre part represents 64 tex and the PU part 174 tex.

This composed "core" is covered by wrapping with a 440 dtex Para-aramid multifilament B" and the Young's modulus is between 60 and 120 GPa. The covering is with touching turns with a helix pitch of 3 mm for a twist of 333 turns/metre in the S or Z direction.

A second covering C" is produced with a 440 dtex multifilament made of polyethylene having a high molecular weight (>600 000 g/mol), having undergone an airjet-type texturizing operation in order to give all the multifilaments cohesion.

300 turns/metre twist, the reverse of the previous wrapping.

A third wrapping is finally produced with a 440 dtex polyethylene multifilament having a high molecular weight (>600 000 g/mol), having undergone an airjet-type texturizing operation in order to give all the multifilaments cohesion.

280 turns/metre twist applied in the reverse direction of the second wrapping.

The complete yarn achieves an overall linear density of 238+44+44+44=370 tex and is used in weaving with a 2/2 twill weave for the production of an apron used in industrial abattoirs, in order to protect operators simultaneously from the risks of being cut and perforated by the various knives used.

The performance levels achieved are very high and similar to metal protection solutions that are much more restrictive for operators, particularly because of the weight of the equipment.

The invention claimed is:

1. Cut-resistant yarn, comprising a core obtained by coextrusion of a glass fiber part comprised of a multifilament of E-, R-, C- or S-glass, or of textile glass or basalt filament, and of a sheath of polymer of thermoplastic, thermosetting, natural elastomer or synthetic elastomer, optionally fluorinated, wherein the glass fiber part represents at most 60% by weight of the core, and wherein the core is wrapped with synthetic multifilaments.

2. Yarn according to claim 1, wherein the core is doubly or triply wrapped with synthetic multifilaments.

3. Yam according to claim 1, wherein the synthetic multifilaments are chosen from the group consisting of polyethylene having a high molecular weight greater than 600,000 g/mol, para-aramid having a modulus >50 Gpa, high-tenacity and standard-tenacity polyamide, high-tenacity and standard-tenacity polyester, liquid-crystal polymer (LCP), polyphenylenebenzobisoxazole (PBO) and ceramic-filled polyester.

4. Yarn according to claim 1, wherein the synthetic multifilaments consist of identical materials.

5. Yarn according to claim 1, wherein the synthetic multifilaments comprise, at least for some of them, different materials.

6. Yarn according to claim 2, wherein the multifilaments are chosen from the group consisting of polyethylene having a high molecular weight greater than 600,000 g/mol, para-aramid having a modulus >50 Gpa, high-tenacity and standard-tenacity polyamide, high-tenacity and standard-tenacity polyester, liquid-crystal polymer (LCP), polyphenylenebenzobisoxazole (PBO) and ceramic-filled polyester.

7. Yarn according to claim 2, wherein the synthetic multifilaments consist of identical materials.

8. Yarn according to claim 3, wherein the synthetic multifilaments consist of identical materials.

9. Yam according to claim 2, wherein the synthetic multifilaments comprise, at least for some of them, different materials.

10. Yam according to claim 3, wherein the synthetic multifilaments comprise, at least for some of them, different materials.

* * * * *